US009278534B2

(12) United States Patent
Munro et al.

(10) Patent No.: US 9,278,534 B2
(45) Date of Patent: Mar. 8, 2016

(54) TRANSLATABLE WEB SUPPORT

(75) Inventors: Michael W. Munro, Escondido, CA (US); Antoni S. Murcia, San Diego, CA (US); Adam Livingston, San Diego, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 2082 days.

(21) Appl. No.: 12/252,208

(22) Filed: Oct. 15, 2008
(Under 37 CFR 1.47)

(65) Prior Publication Data

US 2010/0091065 A1 Apr. 15, 2010

(51) Int. Cl.
*B41J 2/165* (2006.01)

(52) U.S. Cl.
CPC ..... *B41J 2/16535* (2013.01); *B41J 2/16585* (2013.01)

(58) Field of Classification Search
None
See application file for complete search history.

(56) References Cited

U.S. PATENT DOCUMENTS

| | | | | |
|---|---|---|---|---|
| 4,571,601 | A * | 2/1986 | Teshima | 347/33 |
| 4,928,120 | A | 5/1990 | Spehrley, Jr. et al. | |
| 5,610,640 | A | 3/1997 | Anderson et al. | |
| 5,757,387 | A * | 5/1998 | Manduley | 347/2 |
| 6,312,090 | B1 | 11/2001 | Griffin et al. | |
| 6,382,767 | B1 | 5/2002 | Greive | |
| 6,929,346 | B2 | 8/2005 | Balcan et al. | |
| 7,073,902 | B2 * | 7/2006 | Codos et al. | 347/102 |
| 7,140,716 | B2 | 11/2006 | Jensen et al. | |
| 7,165,826 | B2 | 1/2007 | Sugaya | |
| 7,215,351 | B2 * | 5/2007 | Mindler | 347/176 |
| 8,162,436 | B2 * | 4/2012 | Takahashi et al. | 347/33 |
| 2005/0156995 | A1 * | 7/2005 | Nishino | 347/33 |
| 2006/0209152 | A1 * | 9/2006 | Baringa et al. | 347/104 |

* cited by examiner

*Primary Examiner* — Alejandro Valencia
(74) *Attorney, Agent, or Firm* — Rathe Lindenbaum LLP

(57) ABSTRACT

A method and apparatus service a print head by translating a first web support relative to a second web support to adjust a length of a web extending between the first support and the second support.

19 Claims, 9 Drawing Sheets

TRANSLATABLE WEB SUPPORT

BACKGROUND

Printing systems utilize print heads to form images. Existing systems for servicing the print heads constrain architectural freedom in the design of the printing system while often being undesirably complex and space consuming.

DETAILED DESCRIPTION OF THE EXAMPLE EMBODIMENTS

Figure 1:
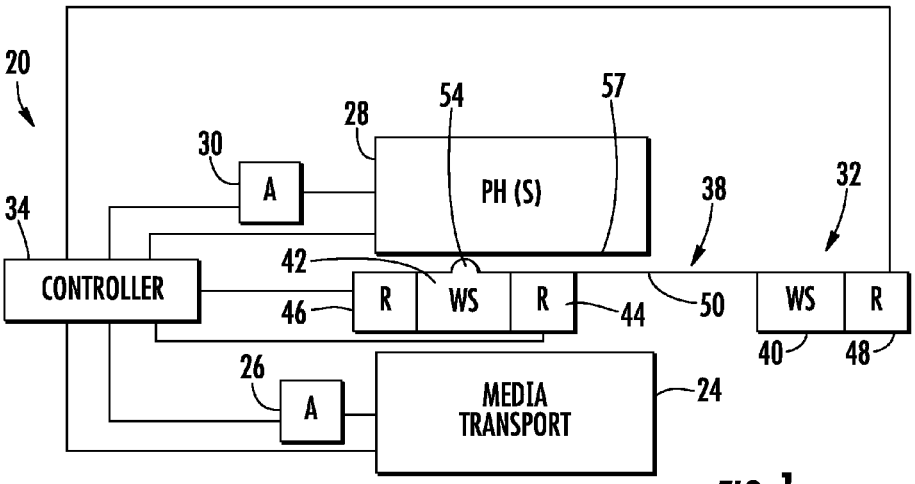
FIG. 1 is a side elevational view schematically illustrating a printing system during wiping of one of more print heads according to an example embodiment.
Figure 2:
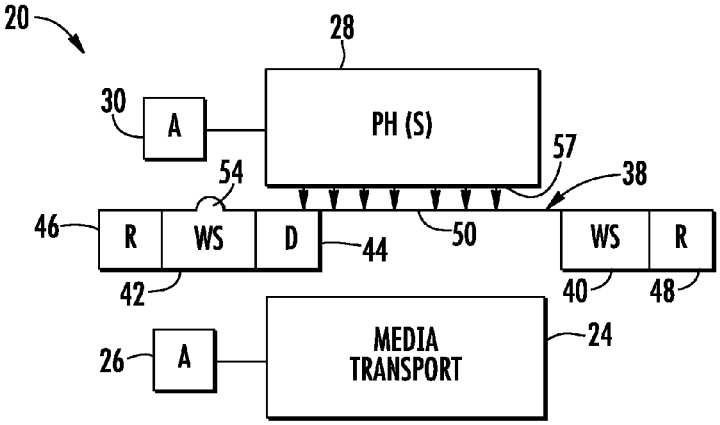
FIG. 2 is a side elevational view schematically illustrating the printing system of FIG. 1 during priming of the one of more print heads according to an example embodiment.
Figure 3:
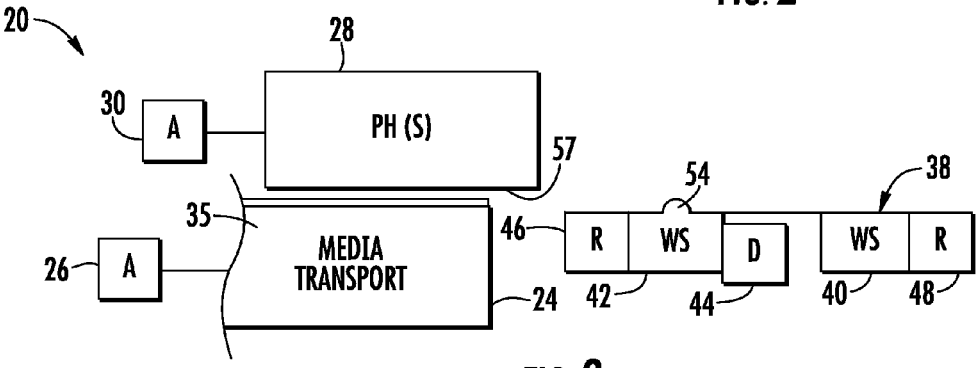
FIG. 3 is a side elevational view schematically illustrating the printing system of FIG. 1 during printing using the one of more print heads according to an example embodiment.

FIGS. 1-3 schematically illustrate imaging, marking or printing system 20 according to an example embodiment. Printing system 20 utilizes one or more print heads to form an image upon a substrate or printed medium. As will be described hereafter, printing system 20 utilizes a print head servicing system which provides packaging or architectural flexibility for printing system 20 while being simple and compact in nature.

As shown by FIGS. 1-3, printing system 20 includes media transport 24 (shown in FIG. 3), media transport actuator 26 (shown in FIG. 3), print heads 28, print head actuator 30, print head servicing system 32 and controller 34. Media transport 24 (schematically shown) comprises a mechanism configured to transport, position or present a print medium or substrate opposite to the one or more print heads 28 such that the one or more print heads 28 may apply, deposit, eject or pattern imaging material upon the print medium. In one embodiment, the print medium may comprise a web of material. In another embodiment, print medium may comprise an individual sheet of material. Media transport 24 may comprise one or more rollers, one or more belts, one or more drums or one or more media guides configured to direct media opposite to print heads 28.

Media transport actuator 26 comprises a mechanism configured to move media transport 24 and the supported print medium 35 (shown in FIG. 3) relative to print heads 28 in a direction substantially perpendicular to print heads 28 to adjust a spacing between print heads 28 and media transport 24. Media transport actuator 26 moves media transport 24 between a servicing position (shown in FIGS. 1 and 2) and a printing position (shown in FIG. 3). In the printing position, media transport actuator 26 positions or supports print medium 35 in close proximity to print heads 28 to facilitate printing on print medium 35. In the servicing position, media transport actuator 26 positions or supports media transport 24 at a spaced position with respect to print heads 28 to permit movement of servicing system 32 between media transport 24 and print heads 28. In the embodiment illustrated in which media transport 24 is located below print heads 28, media transport actuator 26 serves as an elevator or lift so as to selectively raise and lower media transport 24 and the supported print medium 35 (shown in FIG. 3) relative to print heads 28.

In one embodiment, media transport actuator 26 may comprise a rack gear coupled to media transport 24 and a motor driven pinion gear in meshing engagement with the rack gear. In other embodiments, media transport actuator 26 may comprise a pneumatic or hydraulic cylinder-piston assembly, an electric solenoid or a powered cam and cam follower arrangement configured to raise and lower media transport 24. In embodiments where media transport 24 is sufficiently close to print heads 28 for printing even during servicing of print heads 28 with servicing system 32 between media transport 24 and print heads 28, media transport actuator 26 may be omitted. In embodiments where print heads 28 are themselves moved towards and away from media transport 24 between a printing position and a servicing position, media transport actuator 26 may be omitted.

Print heads 28 comprises one or more print heads configured to deposit, eject, apply or print in imaging material onto a print medium such as print medium 35. In one embodiment, the imaging material may comprise a liquid such as a liquid ink, a liquid electrostatically charged toner or a liquid comprising a solution containing one or more solutes which are to be selectively patterned or applied by print heads 28. In one embodiment, print heads 28 may comprise one or more drop-on-demand print heads such as a thermoresistive print head or a piezo resistive print head. In one embodiment, print heads 28, collectively, span a width of medium 35. In another embodiment, print heads 28 are carried by a carriage or are otherwise moved or scanned back and forth across a medium 35 being printed upon.

Print head actuator 30 comprises a device or mechanism configured to selectively move print heads 28 towards and away from media transport 24 in a direction substantially perpendicular to print heads 28 (such as perpendicular to the nozzle plate(s) of print heads 28 to vary or adjust a spacing between print heads 28 and media transport 24. Print head actuator 30 moves print heads 28 between a servicing position (shown in FIGS. 1 and 2) and a printing position (shown in FIG. 3). In the printing position, print heads 28 are in close proximity to media transport 24 to facilitate printing on print medium 35. In the servicing position, print heads 28 are sufficiently spaced from media transport 28 to permit movement of servicing system 32 between media transport 24 and print heads 28. In the embodiment illustrated in which media transport 24 is located below print heads 28, print head actuator 30 serves as an elevator or lift so as to selectively raise and lower print heads 28 3) relative to media transport 24.

In one embodiment, print head actuator 30 may comprise a rack gear coupled to print heads 28 and a motor driven pinion gear in meshing engagement with the rack gear. In other embodiments, print head actuator 30 may comprise a pneumatic or hydraulic cylinder-piston assembly, an electric solenoid or a powered cam and cam follower arrangement configured to raise and lower print heads 28. In embodiments where print heads 28 are sufficiently close to media transport 24 for printing even during servicing of print heads 28 with servicing system 32 between media transport 24 and print heads 28, print head actuator 30 may be omitted. In embodiments where media transport 24 is itself moved towards and away from print heads 28 between a printing position and a servicing position, print heads 28 may be stationary and print head actuator 30 may be omitted.

Print head servicing system 32 comprises a mechanism configured to translate or move between media transport 24 and print heads 28 for servicing of print heads 28 and to be translated and withdrawn from media transport 24 and print heads 28 to permit print heads 28 to print upon media supported by media transport 24. Print head servicing system 32 includes web 38, web support 40, web support 42, drive 44, web retractor 46 and web retractor 48. Web 38 comprises a band of one or more materials configured to service print heads 28. In embodiments where print heads 28 include one or more nozzles, web 38 comprises a band of one more materials configured to service the nozzles. In one embodiment, web 38 comprises a band of material configured to be pressed against a lower face of print heads 28 to wipe residual imaging material from the lower face of print heads 28. In one embodiment, web 38 comprises a band of material configured to absorb and retain liquid imaging material ejected from print heads 28. For example, in one embodiment, web 38 may comprise a band or strip of an absorbent woven or nonwoven fabric. In other embodiments, web 38 may comprise other materials which have a surface textures configured to facilitate wiping of print heads 28 and/or are liquid absorbent.

Web supports 40 and 42 comprise structures configured to support web 38 opposite to print heads 28. Web support 40 supports a first portion of web 38 and is generally fixed. In one embodiment, web support 40 comprises one or more rollers, bridges or the like against or about which web 38 at least partially wraps as it is guided to web retractor 48. In embodiments where a web retractor 48 is omitted, web support 40 may be directly affixed to web support 40.

Web support 42 supports a second portion of web 38 and is translatable relative to web support 40 so as to adjust a length of a span 50 of web 38 extending between web support 40 and web support 42. Web support 42 serves as a shuttle for extending and retracting web 38.

According to one embodiment, web support 40 comprises one or more rollers, bridges or the like against or about which web 38 at least partially wraps as it is guided to web retractor 46. In embodiments where a web retractor 46 is omitted, the second portion of web 38 may be directly affixed to web support 42.

In the example illustrated, web support 42 includes a wiping portion 54. Wiping portion 54 elevates a portion of web 38 into contact with the opposing face 57 of print heads 28. As a result, the elevated portion of web 38 may be wiped against face 57 to wipe nozzles or other structures of print heads 28. In one embodiment, wiping portion 54 may comprise one of the rollers, bridges or other structures of web support 40.

Drive 44 comprises a structure configured to guide movement of web support 42 relative to web support 40 and to power or drive such movement. In one embodiment, drive 44 comprises an endless belt supported by a pair of pulleys and affixed to web support 42, wherein one of the pulleys is coupled to a motor by a transmission and driven by the motor. Rotation of one of the pulleys translates web support 42. In another embodiment, drive 44 may be movably guided along a rod, tongue and groove arrangement or track, wherein of support 42 includes a motor driven pinion gear which is an engagement with a rack gear. Rotation of the pinion gear moves or translates web support 42 along the rack gear and relative to web support 40. In yet another embodiment, web support 42 may be translated by other mechanisms such as hydraulic-pneumatic cylinder-piston assemblies, electric solenoids or driven cam and cam follower arrangements.

Web retractors 46 and 48 comprise mechanisms configured to selectively wind or unwind web 38. In particular, when web support 42 is moved farther away from web support 40, one or both of retractors 46, 48 release additional lengths of web 38 to accommodate the longer length of span 50. When web support 42 is moved towards web support 40, one or both of retractors 46, 48 take-up web 38 such that web 38 remains in tension between web supports 40 and 42. In some embodiments, one or both of web retractor's 46, 48 may comprise a reel, spool or the like, wherein one of the spools of retractors 46, 48 supplies fresh, unused and clean portions of web 38 while the other of the spools takes up used or soiled portions of web 38. In one embodiment, one or both of retractors 46 may comprise a spool or reel rotationally driven by a motor to wind or unwind web 38. In other embodiments, other mechanisms such as torsion springs may be used to allow unwinding of web 38 from a reel and to automatically wind web 38 about the spool to remove excessive slack from web 38 as web support 42 is translated towards web support 40.

Although print head servicing system 32 is illustrated as including two web retractors 46, 48, in other embodiments, system 32 may alternatively include a single retractor. In such an embodiment with a single retractor, one end of web 38 may be coupled to the one retractor while the other end of web 38 is directly connected to one of web supports 40, 42. Although web support 40 has been described as being stationarily fixed so to not move or translate relative to web support 42, in other embodiments, web support 40 may also be movably supported and may also be provided with a drive similar to drive 44 configured to translate web support 40 relative to web support 42. Although web 38 is illustrated as having one end secured to retractor 48 proximate web support 40 and a second end secured to retractor 46 proximate to web 42, in other embodiments, web 38 may alternatively wrap about web support 42 and return or extend in a direction back towards web support 40. In such an embodiment, the retractor 46 would be supported proximate to web support 40. In such an embodiment, web retractor 46 would not be carried by web support 42 and driven by drive 44.

Controller 34 comprises one or more processing units configured to generate control signals directing the operation of media transport actuator 26, print head actuator 30, drive 44, retractors 46, 48, media transport 24 and print heads 28. In one embodiment, controller 34 communicates to such components using one or more wires or electrical traces. In another embodiment, such communication is performed wirelessly.

For purposes of this application, the term "processing unit" shall mean a presently developed or future developed processing unit that executes sequences of instructions contained in a memory or computer or processor readable medium. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 34 may be embodied as part of one or more application-specific integrated circuits (ASICs). Unless otherwise specifically noted, the controller is not limited to any specific combination of hardware circuitry and software, nor to any particular source for the instructions executed by the processing unit.

FIGS. 1-3 illustrate operation of printing system 20. FIG. 1 illustrates a wiping operation. FIG. 2 illustrates a priming or spitting operation. FIG. 3 illustrates a printing operation.

Figure 4:
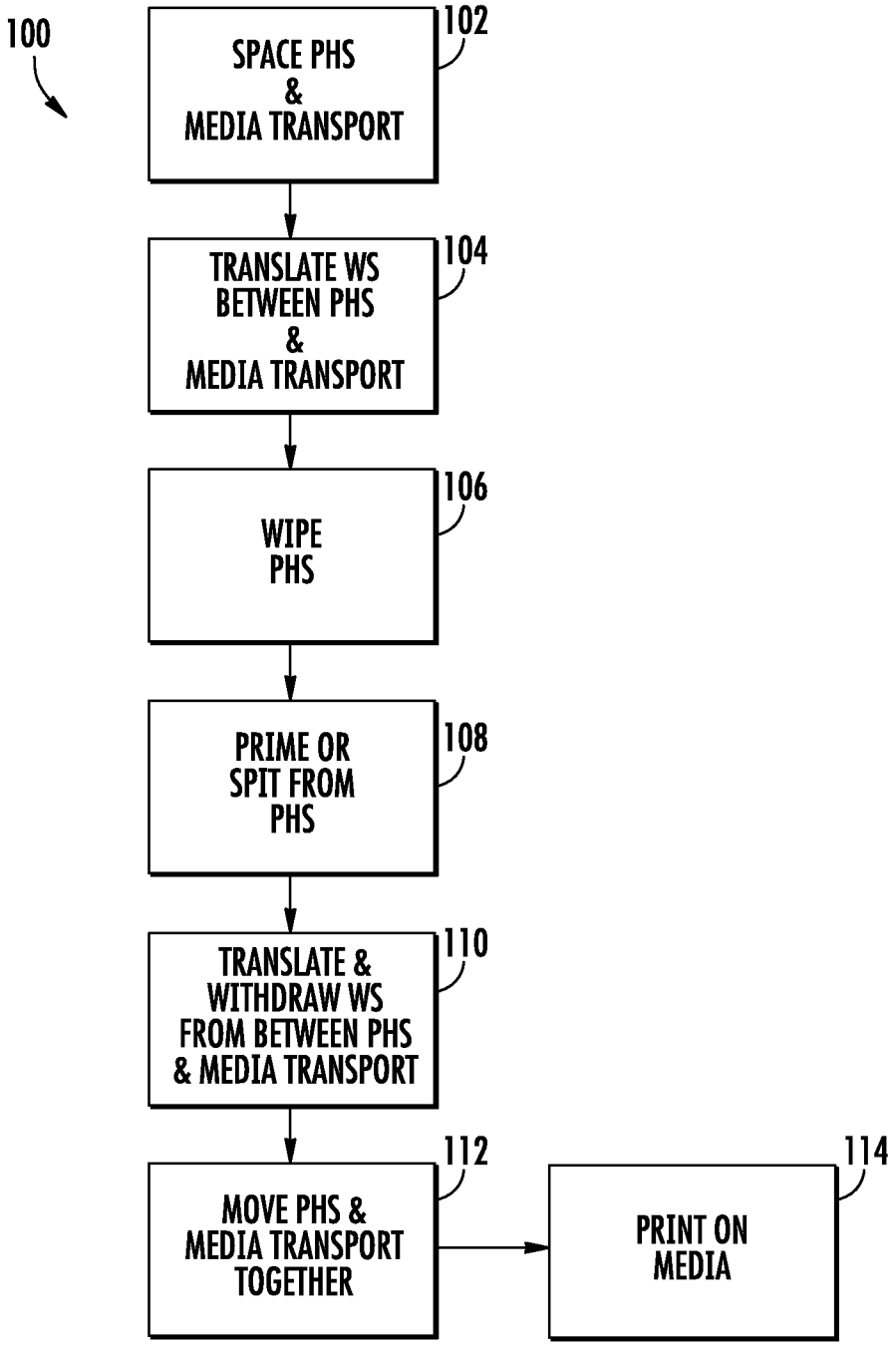
FIG. 4 is a flow diagram illustrating one example method of operating the printing system of FIG. 1 according to an example embodiment.

FIG. 4 is a flow diagram of one example method for operating printing system 20. In response to a sensed degradation of print quality, a predefined servicing schedule or commands or inputs from a person, controller 34 may initiate servicing of print heads 28. As indicated by step 102 and illustrated in FIG. 1, to initiate servicing, controller 34 generates control signals directing one or both of actuators 26, 32 move one or both of media transport 24 and print heads 28 away from one another a distance sufficiently large enough to receive web support 42 between media transport 24 and print heads 28.

As indicated by step 104 and 106 and shown in FIG. 1, controller 34 generates control signals directing drive 44 to translate web support 42 away from web support 40 between media transport 24 and print heads 28. In one embodiment, such translation of web support 42 occurs without any media supported by media transport 24 opposite to print heads 28. In another embodiment, such translation of web support 42 occurs while media (web or sheets of media) are supported by media transport 24 between media transport 24 and web support 42.

The translation of web support 42 away from web support 40 increases the length of span 50 (shown in FIG. 1. To accommodate this increase, controller 34 also generates control signals directing one or both of web retractors 46 to unwind additional lengths of web 38. In one embodiment, controller 34 may alternatively generate control signals directing one of retractors 46 to unwind clean or unused portions of web 38 and the other of retractors 46, 48 to wind or take up previously used or soiled portions of web 38. This results in a clean or unused portion of web 38 being presented opposite to print heads 28 for servicing.

During such translation of web support 42, wiping portion 54 presses web 38 against face 57 of print heads 28 to wipe face 57. This wiping occurs as web support 42 is moved across face 57 of print heads 28. In one embodiment, such wiping may occur as web support 42 moves away from web support 40. In another embodiment, such wiping may occur as web support 42 moves towards web support 40. In yet other embodiments, wiping portion 54 may be omitted and the wiping of print heads 28 may not be performed by web support 54.

As indicated by step 108 and illustrated in FIG. 2, to prime the nozzles and spit liquid imaging material from print heads 28, controller 34 generates control signals directing print heads 28 to eject liquid imaging material or ink onto the extended span 50 of web 38. In one embodiment, controller 34 waits until span 5338 substantially extends across print heads 28 prior to initiating such priming or spitting. In another embodiment, controller 38 may generate control signals causing print heads 28 to eject imaging material onto span 50 while span 50 is being extended opposite to print heads 28. Thus, the same web 38 is used for both wiping of print heads 28 and for the priming or spitting of print heads 28.

As indicated by step 110 and illustrated in FIG. 3, once servicing of print heads 28 is complete, controller 34 (shown in FIG. 1) generates control signals directing drive 44 to translate web support 42 towards web support 40 to withdraw web support 42 from between media transport 24 and print heads 28. During such withdrawal, controller 34 generates control signals causing web retractors 46 and 48 to take up excessive slack in web 38. As indicated by step 112, once with support 42 and span 50 of web 38 have been withdrawn from between print heads 28 and media transport 24, controller 34 generates control signals causing one or both of actuators 26, 30 to move one or both of media transport 24 and print heads 28, respectfully, away from one another to decrease a space or gap between media transport and print heads 28 until media transport 24 is sufficiently close to printed 28 for printing. As indicated by step 114, controller 34 generates control signals directing print heads to print onto print medium 35. In embodiments where print medium 34 is not supported by media transport 24 during servicing, controller 34 may generate control signals causing media transport 24 to position print medium 34 opposite to print heads 28 prior to such printing.

Overall, printing system 20 provides packaging or architectural flexibility for printing system 20 while being simple and compact in nature. In particular, because web support 42, serving as a shuttle, carries just an active portion of web 38 under print heads 28 for servicing, a bulk of the remainder of web 38 may remain elsewhere in the system. For example, the spools or rolls of web 38 may be located or provided outside of print heads 28 and outside of media transport 24. Although web retractors 46, 48 are illustrated as to a side of media transport 24, retractors 46, 48 may alternatively extend above print heads 28 or even below media transport 24. Because of support 42 carries just inactive portion of web 38 under print heads 28 for servicing, the distance by which print heads 28 or media transport 24 are moved closer to one another for printing or apart from one another for servicing is also reduced, simplifying printing system 20.

Figure 5:
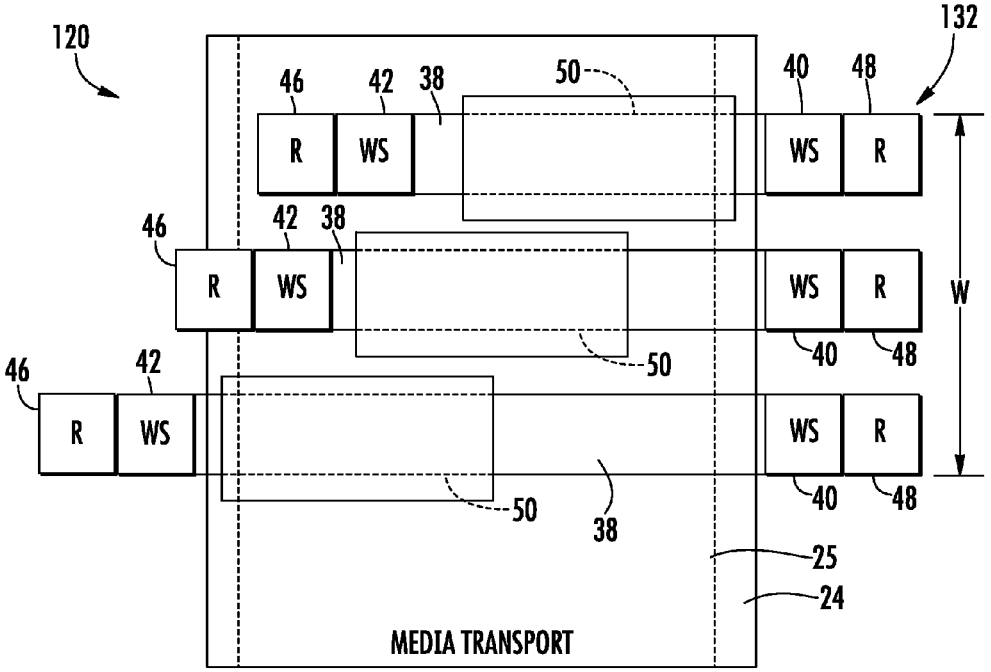
FIG. 5 is a top plan view schematically illustrating another embodiment of the printing system of FIG. 1 according to an example embodiment.

FIG. 5 schematically illustrates printing system 120, another embodiment of printing system 20. Printing system 120 is similar to printing system 20 in all respects except that printing system 120 includes a plurality of print heads 28, a plurality of print heads actuators 30 (shown in FIG. 1) and a plurality of print head servicing systems 32. As shown by FIG. 5, each of the plurality of print heads 28 are staggered across media transport 24 so as to collectively span the entire media path 25 of media transport 24. As a result, an entire width of a medium may be printed upon during a single pass of the medium by media transport 24.

Although printing system 20 is illustrated as including three sets of print heads 28 or three sets of print bars 28, in other embodiments, printing system 120 may alternatively include a pair of print heads 28 or greater than three print heads 28. In other embodiments, printing system 120 may alternatively utilize a single print head servicing system 32, wherein web 38 has a sufficient width W so as to extend opposite to each of the plurality of staggered print heads 28.

Figure 8:
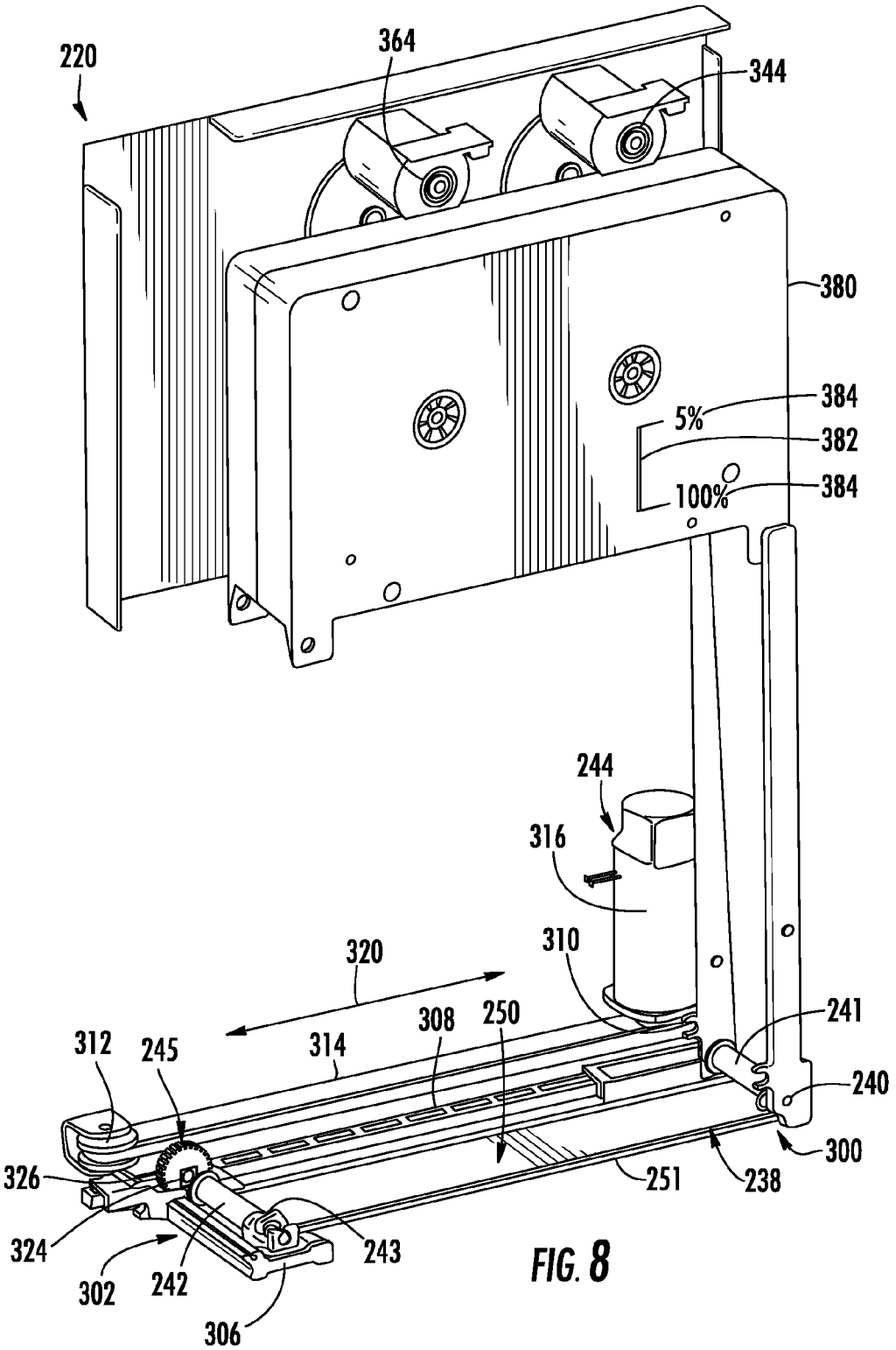
FIG. 8 is a perspective view of the printing system of FIG. 6 with the servicing web retracted according to an example embodiment.
Figure 9:
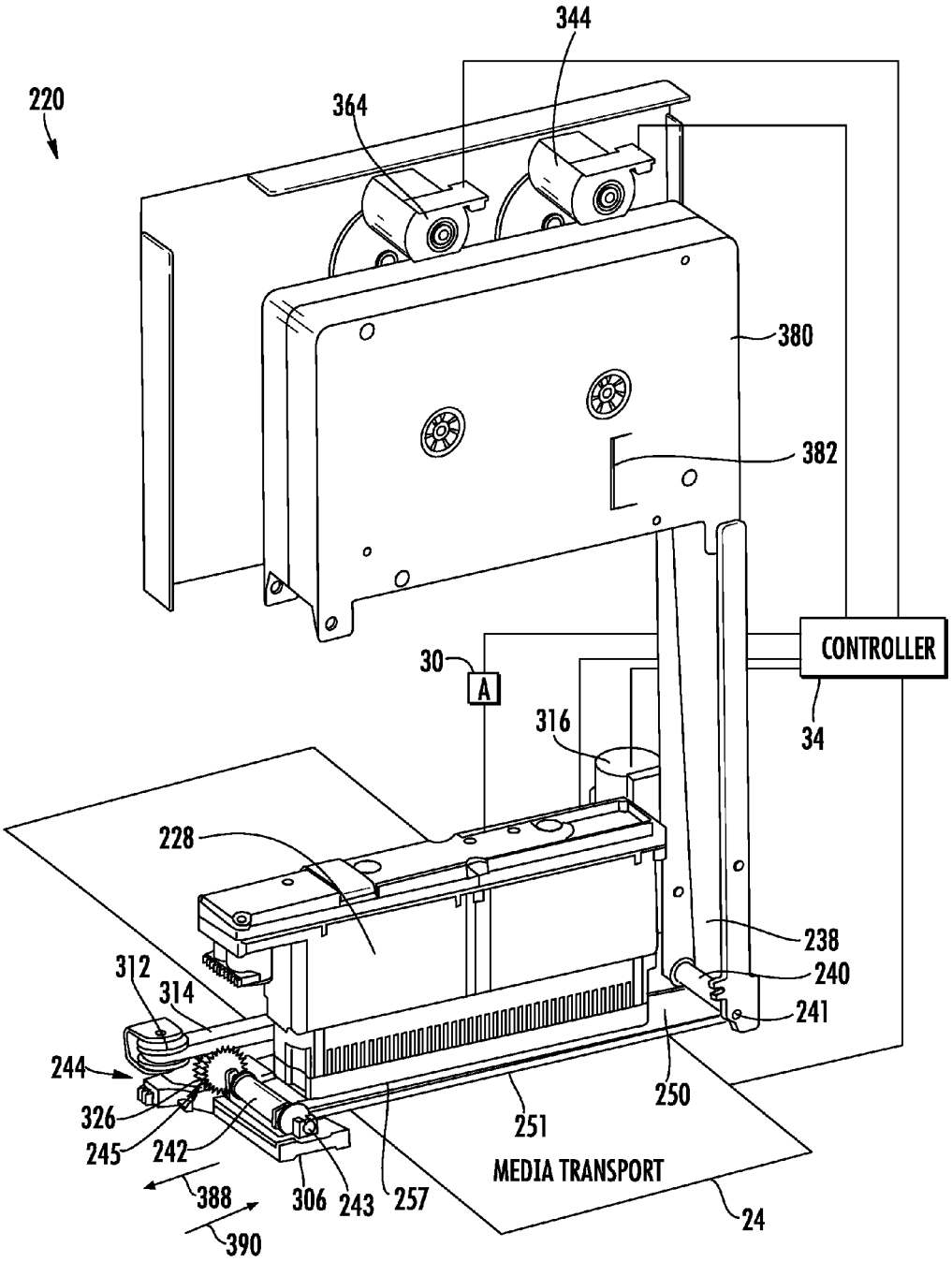
FIG. 9 is a perspective view of the printing system of FIG. 6 illustrating servicing of one of more print heads with the web extended according to an example embodiment.
Figure 10:
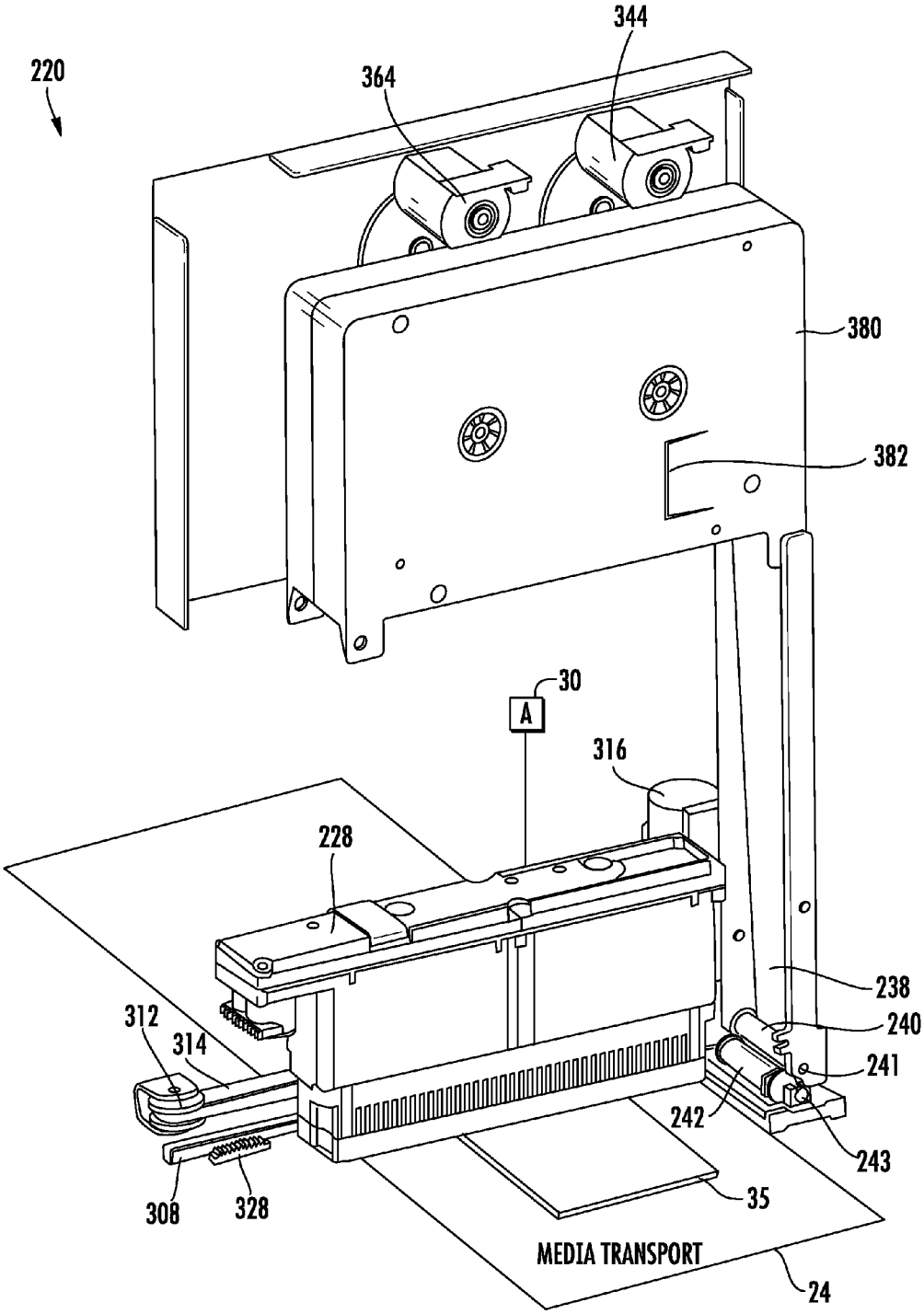
FIG. 10 is a perspective view of the printing system of FIG. 6 illustrating printing with the one of more print heads while the web is retracted according to an example embodiment.

FIGS. 6-10 illustrate printing system 220, another embodiment of printing system 20. Printing system 220 includes media transport 24 (shown in FIGS. 6 and 9), print heads 228 (shown in FIGS. 9 and 10), print head actuator 30 (shown in FIGS. 9 and 10) print head servicing system 232 and controller 34 (shown in FIG. 9). Media transport 24 is described above with respect to printing system 20. As shown by FIG. 10, media transport 24 is configured to position a substrate or print medium 35 opposite to print heads 228 during printing.

Print heads 228 comprises one or more print heads configured to deposit, eject, apply or print in imaging material onto a print medium such as print medium 35. In the embodiments illustrated, the imaging material comprises a liquid such as a liquid ink or a liquid comprising a solution containing one or more solutes which are to be selectively patterned or applied by print heads 228. In one embodiment, print heads 228 may comprise one or more drop-on-demand print heads such as a thermo resistive print head or a piezo resistive print head. In one embodiment, print heads 228, collectively, span a width of medium 34. In another embodiment, print heads 228 are staggered with respect to other similar print heads 228 so as to collectively span a width of the medium 35. In alternative embodiments, print heads 228 are carried by a carriage or are otherwise moved or scanned back and forth across a medium 35 being printed upon.

Print head actuator 30 (schematically shown in FIGS. 9 and 10) is described above with respect to printing system 20. Print head actuator 30 moves print heads 228 between a servicing position (shown in FIG. 9) and a printing position (shown in FIG. 10). In the printing position, print heads 228 are in close proximity to media transport 24 to facilitate printing on print medium 35. In the servicing position, print heads 228 are sufficiently spaced from media transport 24 to permit movement of servicing system 132 between media transport 24 and print heads 228. In the embodiment illustrated in which media transport 24 is located below print heads 228, print head actuator 30 serves as an elevator or lift so as to selectively raise and lower print heads 228 relative to media transport 24.

Figure 6:
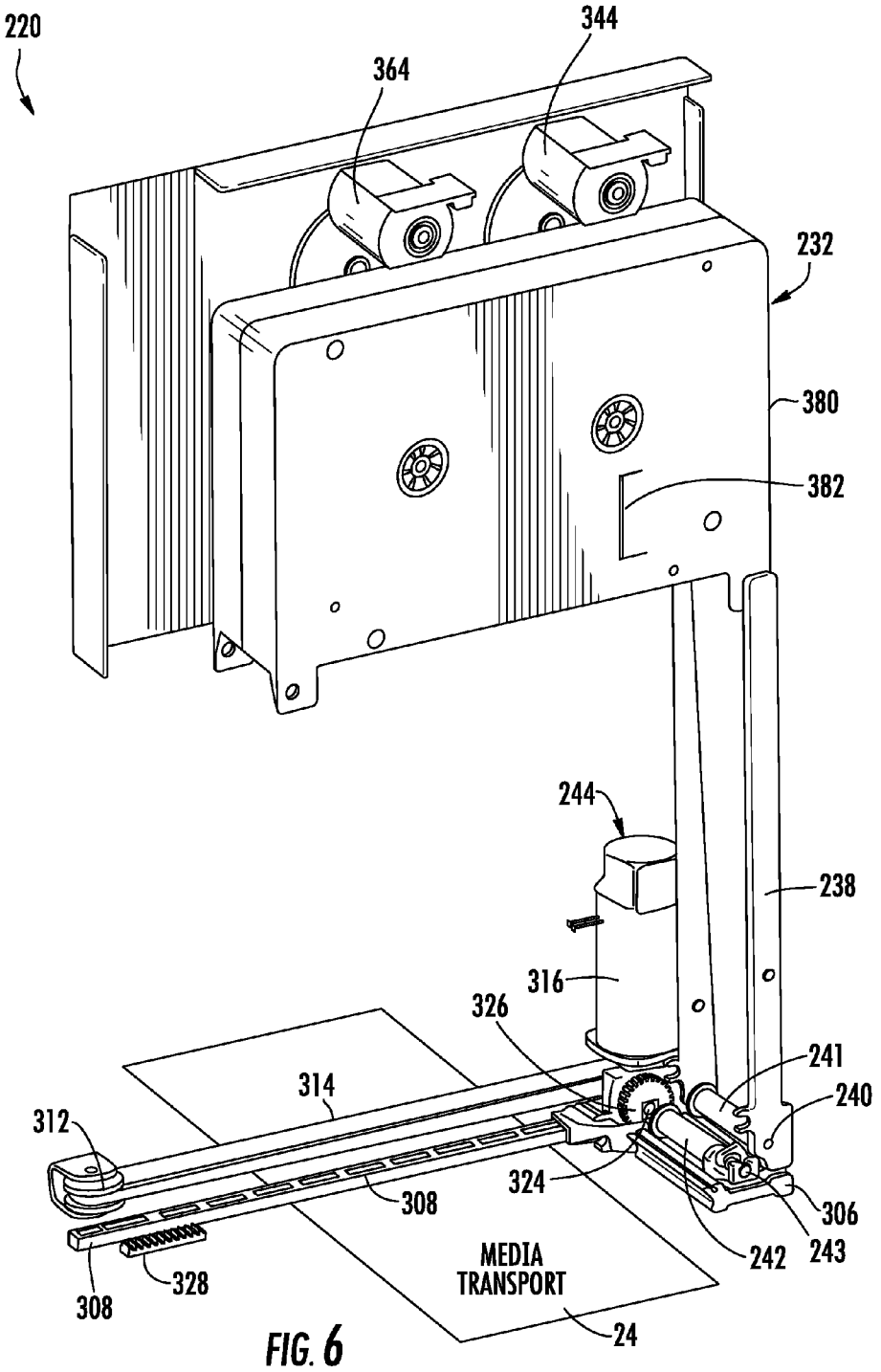
FIG. 6 is a perspective view illustrating another embodiment of the printing system of FIG. 1 with a servicing web extended according to an example embodiment.
Figure 7:
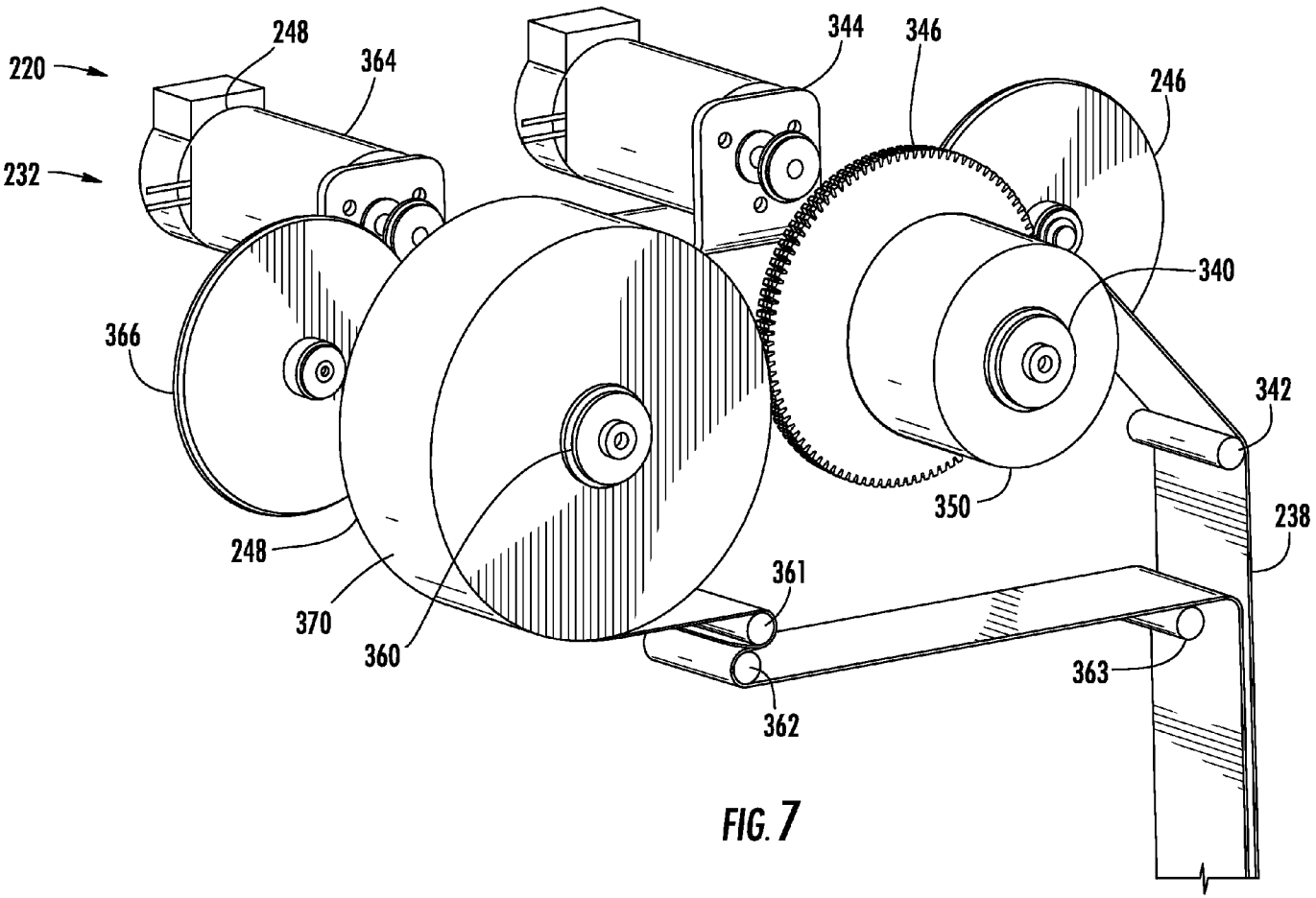
FIG. 7 is a perspective view of web retractors of the printing system of FIG. 6 according to an example embodiment.

Print head servicing system 232 is shown in detail in FIGS. 6-8 which omit print heads 228 and actuator 30 for purposes of illustration. Print head servicing system 232 comprises a mechanism configured to translate or move between media transport 24 and print heads 228 for servicing of print heads 228 and to be translated and withdrawn from media transport 24 and print heads 228 to permit print heads 228 to print upon media supported by media transport 24. Print head servicing system 232 includes web 238, web supports 240, 241, web support 242, 243, drive 244, web incrementer 245, web retractor 246 and web retractor 248. Web 238 comprises a band of one or more materials configured to service print heads 228. In embodiments where print heads 228 include one or more nozzles, web 238 comprises a band of one more materials configured to service the nozzles. In one embodiment, web 238 comprises a band of material configured to be pressed against a lower face of print heads 228 to wipe residual imaging material from the lower face of print heads 228. In one embodiment, web 238 comprises a band of material configured to absorb and retain liquid imaging material ejected from print heads 228. For example, in one embodiment, web 238 may comprise a band or strip of an absorbent woven or non-woven fabric. In other embodiments, web 238 may comprise other materials which have a surface textures configured to facilitate wiping of print heads 228 and/or are liquid absorbent.

Figure 8A:
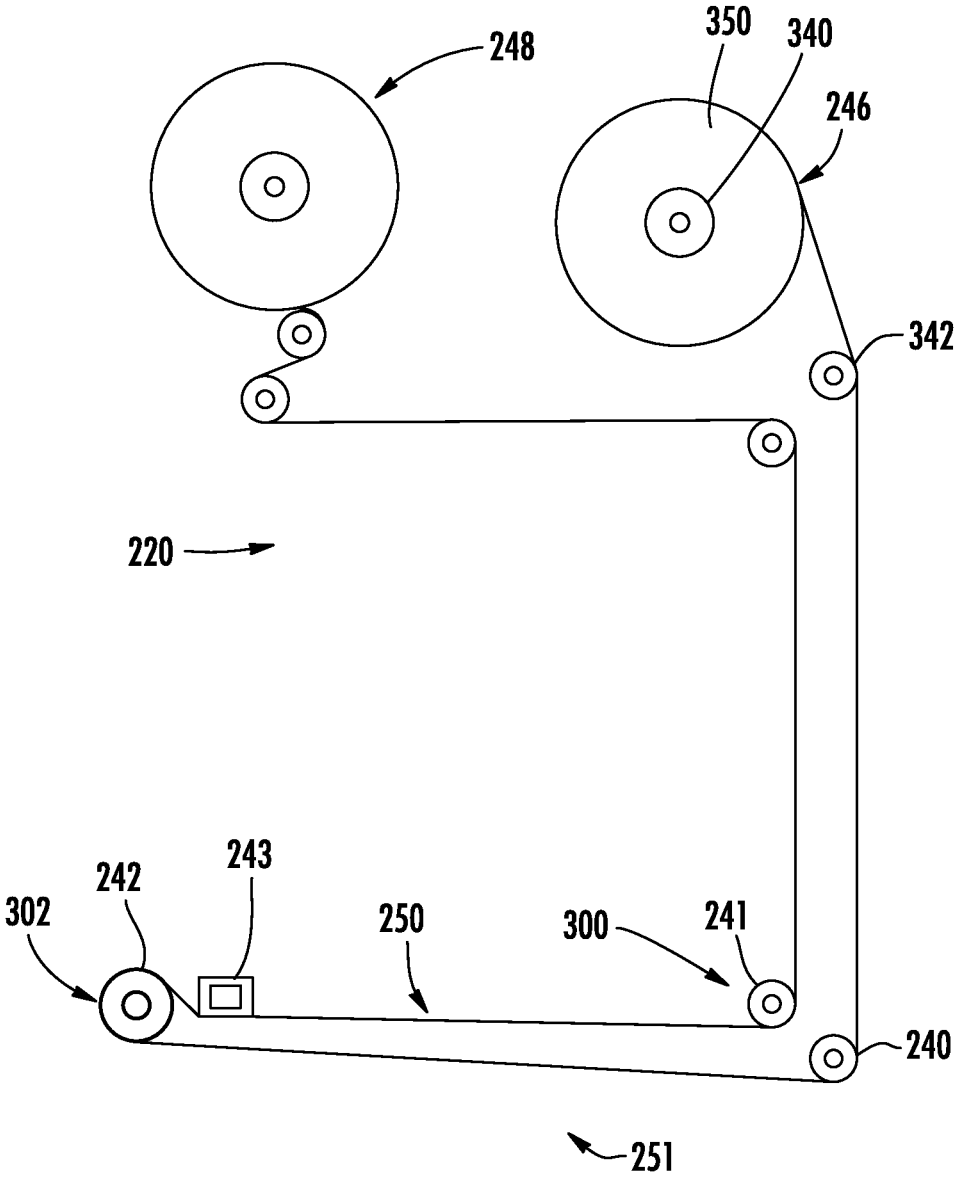

Web supports 240-243 are shown in detail in FIGS. 8 and 8A. Web supports 240-243 comprise structures configured to support web 238 opposite to print heads 228. Web supports 240 and 241 support a first portion 300 of web 38 and are generally fixed so as to not substantially translate. In the embodiment illustrated, web support 240 comprises a rotationally supported roller about which web 38 at least partially wraps as it is guided from web retractor 246 to web support 242 as shown in FIG. 8A. In other embodiments, web support 240 may comprise a bar, rod or other structure guiding the path of travel of web 238.

Web supports 242 and 243 support and guide a second portion 302 of web 238. Supports 242 and 243 are themselves supported by a shuttle 306 which is translatable relative to web supports 240 and 241 so as to adjust a length of an upper span 250 of web 238 extending between web support 243 and 241 and a lower span 251 of web 238 extending between web supports 240 and 242.

In the example illustrated, web support 242 comprises a roller rotationally supported by shuttle 306 and having an uppermost surface elevated above of support 243. The uppermost surface of web support 242 serves as a wiping portion for pressing supported portions of web 238 against heads 228 during wiping. Web support 243 comprises a stationary bridge or bar extending from shuttle 306 and under which web 238 extends. In other embodiments, web support 243 may comprise other structures such as a roller. In embodiments where web incrementer 245 is omitted, web support 242 may alternatively comprise a rigid stationary bar or bridge.

Drive 244 comprises a mechanism configured to guide movement of web supports 242 and 243 relative to web supports 240 and 241 and to power or drive such movement. In the example illustrated, drive 244 is configured to guide and drive translation of shuttle 306 carrying web supports 242 and 243. In the example illustrated, drive 244 includes pulleys guide 308, 310, 312, belt 314 and motor 316. Guide 308 comprises a rod or shaft slidably supporting shuttle 306. In other embodiments, guide 308 may have other configurations.

Pulleys 310, 312 are located at opposite sides of media transport 24 and support belt 314. Belt 314 comprises an endless belt wrapping about pulleys 310, 312. A portion of belt 314 is directly fixed, mounted or joined to shuttle 306. Motor 316 comprises a reversible motor connected to pulleys 310 directly or via an appropriate speed reducing transmission. Motor 316 is configured to rotate pulley 310 in either direction so as to rotate belt 314 so as to translate shuttle 306 and web supports 242, 243 in either of the directions indicated by arrows 322 towards or away from web supports 240, 241. In other embodiments, shuttle 306 may be translated by other mechanisms such as hydraulic-pneumatic cylinder-piston assemblies, rack and pinion gear arrangements, electric solenoids or driven cam and cam follower arrangements.

Web incrementer 245 comprises a mechanism configured to incrementally advance clean, unused portions of web 238 across web support 242 for wiping and to inhibit previously used, soiled portions of web 238 from reversing direction about web support 242. Web incrementer 245 includes one-way clutch 324, pinion gear 326 and rack gear 328 (shown in FIG. 6). One-way clutch 324 is coupled between the roller of web support 242 and pinion gear 326. Clutch 324 is configured to substantially freely rotate relative to one of pinion gear at 326 and the roller of web support 242 in one direction and so as to be non-rotatable relative to the other opinion gure 326 and web support 242 in a second opposite direction. In the example illustrated, clutch 324 is configured to freely rotate relative to the roller of web support 242 in a counter-clockwise direction as seen in FIGS. 8 and 8A while being non-rotatable relative to web support 242 in a clockwise direction. In other words, when pinion gear 326 is rotated in a counter-clockwise direction, little if any torque will be transmitted to the roller of web support 242 such that web support 242 is not rotationally driven. When pinion gear 326 is rotated in a clockwise direction, a more substantial amount of torque will be transmitted to web support 242 to rotate web support 242. In one embodiment, web support 242 will rotate in unison with pinion gear 326 in the clockwise direction. In one embodiment, one-way clutch comprises a one-way clutch such as those commercially available from Koyo Seiko Co. In other embodiments, other one-way clutches may be employed.

Pinion gear 326 comprises a pinion gear joined to one-way clutch 324 and rotationally supported by one-way clutch 324. Pinion gear 326 has teeth configured to meshingly engage corresponding teeth of rack gear 328. Rack gear 328 (shown in FIG. 6) comprises a rack gear on an opposite side of media transport 24 as web supports 240 and 241. Rack gear 328 has teeth configured to meshingly engage the teeth of pinion gear 326. Rack gear 328 has a length sufficient to rotate pinion gear 326 and web support 242 a predetermined distance to increment a predetermined amount of web 238.

In operation, when shuttle 306 is being moved away from web supports 240, 241 and pinion gear 326 is rotating across rack gear 328, pinion gear 326 rotates in a counter-clockwise direction so as to not transmit torque to web support 242. As shuttle 306 is being moved back towards web supports 240, 241, pinion gear 3261 began rotates along rack gear 328 in a clockwise direction. As a result, pinion gear 326 transmits torque to web support 242 via one-way clutch 324. As the roller of web support 242 is rotated, unused portions of web 238 from span 251 are wound about web support 242 so as to be positioned at a top portion of web support 242, ready for subsequent wiping of print heads 228. Those portions of web 238 previously at the top of web support 242 and soiled from previous wiping are incremented or advanced so as to be part of span 250. As will be described hereafter, span 250 receives liquid imaging material during priming or spitting of print heads 228. Because incrementer 245 utilizes a rack and pinion arrangement to increment web 238, incrementer 245 utilizes motor 316 of drive 244 to power such advancement of web 238. As a result of additional motors or power sources are not used.

Although web incrementer 245 is illustrated as using a rack and pinion arrangement, in other embodiments, other mechanisms may be used to selectively advance web 238. For example, in other embodiments, other rotational actuators may be employed to selectively rotate the roller of web support 242. Independent motors may be used to drive web support 242. In still other embodiments, incrementer 245 may be emitted.

FIGS. 7 and 8A illustrate web retractors 246 and a 248 in more detail. Web retractors 246 and 248 comprise mechanisms configured to selectively wind or unwind web 238. In one embodiment, when web supports 242 and 243 are moved farther away from web supports 240 10 241, both of retractors 246, 248 release additional lengths of web 238 to accommodate the longer length of spans 250 and 251. When web supports 242 and 243 are moved towards web supports 240 and 241, both of retractors 246, 248 take-up web 238 such that web 238 remains in tension between web supports 240 and 242.

Web retractor 246 includes spool 340, guide 342, motor 344 and transmission 346. Spool 340 comprises a reel configured to support a supply roll 350 of clean or unused web 238. Guide 342 comprises a cylindrical rod or rotationally supported roller guiding or directing unwound portions of role 350 of web 238 towards web support 240 as shown in FIG. 8A. In other embodiments, additional guides 342 may be utilized or guide 342, itself, may be emitted.

Motor 344 serves as a source of torque for rotationally driving spool 340. Motor 344 transmits torque to spool 340 via transmission 346 and is configured to selectively rotate spool 340 either clockwise or counter-clockwise. In other embodiments, web retractor 246 may have other configurations and may use other mechanisms for rotationally driving spool 340.

Web retractor 248 is similar to web retractor 246 and includes spool 360, guides 361, and 362, 363, motor 364 and transmission 366. Spool 360 comprises a reel configured to support a take-up roll 370 which receives use or soiled portions of web 238. Guides 361-363 guide and direct movement of web 238 from web support 241 (shown FIG. 8A) to take up roll 370. Guides 361-363 each comprise a cylindrical rod, rotationally supported roller or other bearing structure for guiding or directing movement of web 238. In other embodiments, additional guides may be utilized or one of more of guides 361-363 may be omitted depending upon the path of web 238.

Motor 364 serves as a source of torque for rotationally driving spool 370. Motor 364 transmits torque to spool 360 via transmission 366 and is configured to selectively rotate spool 360 either clockwise or counter-clockwise. In other embodiments, web retractor 248 may have other configurations and may use other mechanisms for rotationally driving spool 360. In some embodiments, a torsion spring may be used to assist in winding web 238 about spool 360.

As further shown by FIG. 8, web retractors 246 and 248, including spools 340 and 360, are supported and housed by a housing 380 above media transport 24, above spans 250 and 251. As shown by FIGS. 9 and 10, housing 380 further supports web retractors 246 and 248 above print heads 228. As a result, retractors 246 and 248 are suspended out of the way, providing more valuable space proximate to or adjacent to media transport 24 and print heads 228. Locating retractors 246, 248 and their spools 340, 360 above print heads 228 enables printing system 220 to be more compact and space efficient.

As further shown by FIG. 8, housing 380 includes a window 382 across from spool 340 and roll 350. Window 32 enables a person to visually inspect and determine how much of supply roll 350 has been consumed (soiled) and how much of supply roll 350 remains. In the example illustrated, housing 30 at additionally includes indicia 384 indicating a percentage of supply roll 350 that remains. In other embodiments, housing 30 may alternatively or additionally include a similar window opposite to take up roll 360. In other embodiments, window 382 and indicia 384 may be omitted.

Controller 34 (shown in FIG. 9) is described above with respect to printing system 20. Controller 34 comprises one or more processing units configured to generate control signals directing the operation of media transport 24, print head actuator 230, drive 244, retractors 246, 248 and print heads 228. In one embodiment, controller 34 communicates to such components using one or more wires or electrical traces. In another embodiment, such communication is performed wirelessly.

FIGS. 9 and 10 illustrate operation printing system 220. FIG. 9 illustrates printing system 220 during servicing of print heads 228. As shown by FIG. 9, controller 34 generates control signals directing printed actuator 30 to raise or lift print heads 228 away from the printing position. Controller 34 also generate control signals directing motor 316 of drive 244 to move shuttle 306 in the direction indicated by arrow 388 so as to extend web 238 and so as to lengthen spans 250 and 251. As spans 250 and 251 are lengthened, controller 34 also generates control signals directing motors 344 and 364 of retractors 246 into 48 to unwind rolls 350 and 370, respectfully.

As shuttle 306 is moved in the direction indicated by arrow 388, an upper portion of web support 242 and web 238 are wiped across the lower face 257 of print heads 228. In other embodiments, such wiping may be performed at other times. Once shuttle 306 has been moved to the position shown in FIG. 9, controller 34 generates control signals directing print heads 228 to eject or spit liquid imaging material or ink to clear nozzle openings and to prime print heads 228. The ejected ink is received and absorbed by span 250 of web 238.

Upon completion of such servicing, controller 34 generate control signals directing actuator 30 to raise print heads 228 to permit webs support 242 to be moved beneath print heads 228 without contacting print heads 228. Controller 34 further generates control signals directing motor to drive belt 314 so as to move shuttle 306 in the direction indicated by arrow 390. Upon initial movement of shuttle 306 in the direction indicated by arrow 390, pinion gear 326 is rotated along rack gear 328 (shown in FIG. 6). Torque is transmitted to web support 242 to increment or advance an unused portion of web 238 onto web support 242. This unused portion of web 238 is now ready for subsequent wiping operations. During this initial increment or advancement of web 238, controller 34 may be generating control signals directing motor 344 to unwind supply roll 350 and further directing motor 364 to wind spool 360 to take up additional portions of web 238. After unused portions of web 238 have been incremented onto the wiping portion of web sport 242, controller 34 generates control signals directing both web retractors 246 and 248 to take up or wind up portions of web 238 as shuttle 306 is continued to be driven in the direction indicated by arrow 390. In other embodiments, such wiping may be performed at other times.

FIG. 10 illustrates printing system 220 after shuttle 306 has been fully retracted to a position adjacent to web supports 240 and 241. Consequently, web 238 no longer occupies space between print heads 228 and media transport 24. Controller 34 (shown FIG. 9) generates control to directing media transport 24 to position print medium 35 opposite to print heads 228. Controller 34 further generates control signals directing actuator 30 to lower print heads 228 to the printing position. Thereafter, controller 34 generates control signals directing printed 228 to eject and print imaging material onto print medium 35.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a media transport to move a print medium along a first axis in a first plane;

a first support configured to support a first portion of a web;

a second support configured to support a second portion of the web; and a drive configured to linearly translate the first support relative to the second support along a second axis perpendicular to the first axis and in a second plane parallel to the first plane to adjust a length of a span of the web between the first support and the second support for servicing one or more print heads, wherein the drive is configured to translate the first support between a first position in which the span of the web between the first support and the second support extends across the media transport and a second position in which the span of the web between the first support and the second support is horizontally retracted from the media transport.

2. The apparatus of claim 1, wherein the first support directly underlies a portion of the web configured to contact a face of the one or more print heads as the first support is translated relative to the second support.

3. The apparatus of claim 2, wherein the first support comprises a roller.

4. The apparatus of claim 1 further comprising a supply reel and a take-up reel for the web, wherein the supply reel and a take-up reel are located above the span of the web between the first support and the second support.

5. The apparatus of claim 4, wherein the supply reel and the take-up reel are spaced from the span by a gap configured to receive the one or more print heads.

6. The apparatus of claim 4 further comprising one or more print heads movable along a first direction, wherein the first support is linearly translatable relative to the second support in a second direction substantially perpendicular to the first direction.

7. The apparatus of claim 1, wherein the drive includes a powered actuator coupled to the first support and configured to linearly translate the first support relative to the second support.

8. The apparatus of claim 1 further comprising the web, wherein the web extends along a web path extending from the second support to the first support, about the first support and back towards and directly beneath the second support.

9. The apparatus of claim 8 further comprising a third support proximate to the first support, wherein the web path extends about the third support.

10. The apparatus of claim 1 further comprising the web, wherein the web extends in a flat horizontal plane from the first support to the second support while extending above, but not through, a plane in which the media transport moves the print medium.

11. The apparatus of claim 10 further comprising a supply reel, wherein the web extends substantially vertically between the second support and the supply reel.

12. The apparatus of claim 1 further comprising a media transport configured to support a portion of a print medium in a plane while the portion in the plane is printed upon, wherein the drive is configured to translate the first support relative to the second support in a direction parallel to the plane.

13. An apparatus comprising:

a media transport to move a print medium along a first axis in a first plane;

a first support configured to support a first portion of a web;

a second support configured to support a second portion of the web; and a drive configured to linearly translate the first support relative to the second support along a second axis perpendicular to the first axis and in a second plane parallel to the first plane to adjust a length of a span of the web between the first support and the second support for servicing one or more print heads; and one or more print heads, wherein the drive is configured to translate the first support between a first position in which the span of the web between the first support and the second support extends across and opposite to the one or more print heads at a location and a second position in which the span of the web between the first support and the second support is retracted and horizontally offset from the one or more print heads at the location.

14. The apparatus of claim 1, wherein a face of the web between the first support and the second support in not contacted by any intermediate support between the first support and the second support.

15. An apparatus comprising:

one or more printheads;

a media transport configured to move a print medium relative to the one or more printheads;

a first support configured to support a first portion of a web directly above the media transport;

a second support configured to support a second portion of the web; and a drive configured to translate the first support relative to the second support to adjust a length of a span of the web between the first support and the second support and to adjust an extent to which the web covers the media transport for servicing one or more print heads, wherein the drive is configured to translate the first support to move the first support between a first position in which the span of the web between the first support and the second support extends across the media transport during servicing of the one or more print heads and a second position in which the span of the web between the first support and the second support is horizontally retracted from the media transport while the one or more print heads print upon the print medium.

16. An apparatus comprising:

a first support configured to support a first portion of a web and provide an axis about which the web turns to reverse a horizontal direction of the web such that a first portion of the web overlaps a second portion of the web in a vertical direction;

a second support configured to support a second portion of the web; and a drive configured to translate the first support relative to the second support to move the axis about which the web turns to adjust a length of a span of the web between the first support and the second support for servicing one or more print heads; and one or more print heads, wherein the drive is configured to translate the first support between a first position in which the span of the web between the first support and the second support extends across and opposite to the one or more print heads at a location and a second position in which the span of the web between the first support and the second support is retracted and horizontally offset from the one or more print heads at the location.

17. The apparatus of claim 16 further comprising a media support to move a print medium in a first flat plane, wherein when the first support is in the first position, a complete length of the web that extends between the first support and the second support is in a second flat plane.

18. The apparatus of claim 16 further comprising a media transport to move a print medium in a first flat plane, wherein when the first support is in the first position, a complete length of the web that extends between the first support and the second support is vertically above the first flat plane.

19. The apparatus of claim 16 further comprising a media transport, wherein the first support, in the first position, is to be located on a first side of the media transport outwardly beyond a first edge of the media transport and wherein the first support, in the second position, is to be located on a second side of the media transport outwardly beyond a second edge of the media transport.

* * * * *